US010758033B2

(12) United States Patent
Dahlberg

(10) Patent No.: US 10,758,033 B2
(45) Date of Patent: Sep. 1, 2020

(54) CASSETTE BRUSH, A VEHICLE PROVIDED THEREWITH AND A METHOD OF PRODUCING A CASSETTE ELEMENT FOR A CASSETTE BRUSH

(71) Applicant: SVENSKA INDUSTRIBORSTAR I VÄSTERÅS AB, Västerås (SE)

(72) Inventor: Cecil Dahlberg, Västerås (SE)

(73) Assignee: Svenska Industriborstar I Västerås AB, Västerås (SE)

( * ) Notice: Subject to any disclaimer, the term of this patent is extended or adjusted under 35 U.S.C. 154(b) by 382 days.

(21) Appl. No.: 15/543,798

(22) PCT Filed: Jan. 13, 2016

(86) PCT No.: PCT/SE2016/050011
§ 371 (c)(1),
(2) Date: Jul. 14, 2017

(87) PCT Pub. No.: WO2016/114709
PCT Pub. Date: Jul. 21, 2016

(65) Prior Publication Data

US 2018/0008033 A1 Jan. 11, 2018

(30) Foreign Application Priority Data

Jan. 16, 2015 (SE) ..... 1550031

(51) Int. Cl.
*A46B 7/04* (2006.01)
*A46B 3/16* (2006.01)
(Continued)

(52) U.S. Cl.
CPC ..... *A46B 7/044* (2013.01); *A46B 3/16* (2013.01); *A46B 13/001* (2013.01);
(Continued)

(58) Field of Classification Search
CPC ..... A46B 3/16; A46B 7/044; A46B 13/001; A46B 13/005; A46B 2200/3066; E01H 1/056
See application file for complete search history.

(56) References Cited

U.S. PATENT DOCUMENTS 642,484 A 1/1900 Phillips
4,302,863 A 12/1981 Droeser
(Continued)

FOREIGN PATENT DOCUMENTS

CA 654458 A 12/1962
GB 754953 A 8/1956
(Continued)

*Primary Examiner* — Randall E Chin
(74) *Attorney, Agent, or Firm* — Dilworth & Barrese, LLP

(57) ABSTRACT

A brush (1) intended for industrial use comprises one or more bristle bunches formed by a plurality of elongated bristles, one or more cassette elements having said bristle bunches, and a cassette element holding member (3) at which said cassette elements may be removably secured. At least one of said cassette elements comprises a body, one or more recesses configured to receive said bristle bunches therein, and a securing wire configured to secure said bristle bunches in said recesses. Said at least one cassette element further comprises means configured to counteract movement of the bristles of a bristle bunch with respect to each other and/or with respect to the securing wire.

20 Claims, 6 Drawing Sheets

(51) Int. Cl.

| | |
|---|---|
| ***A46B 13/00*** | (2006.01) |
| ***E01H 1/05*** | (2006.01) |
| ***E01H 5/09*** | (2006.01) |
| ***E21B 43/08*** | (2006.01) |
| ***A46B 13/02*** | (2006.01) |
| ***A46D 1/00*** | (2006.01) |
| *A46D 3/05* | (2006.01) |

(52) U.S. Cl.

CPC ..... *A46B 13/005* (2013.01); *A46B 13/02* (2013.01); *A46D 1/0207* (2013.01); *E01H 1/056* (2013.01); *E01H 5/092* (2013.01); *E21B 43/084* (2013.01); *A46B 2200/3066* (2013.01); *A46D 3/05* (2013.01)

(56) References Cited

U.S. PATENT DOCUMENTS

| | | | | | |
|---|---|---|---|---|---|
| 5,445,438 | A | * | 8/1995 | Drumm | A46B 3/18 15/183 |
| 5,606,762 | A | | 3/1997 | Droeser et al. | |
| 5,762,404 | A | * | 6/1998 | Drumm | A46B 3/08 300/21 |
| 5,819,357 | A | * | 10/1998 | Gould | A46B 13/005 15/182 |
| 6,217,124 | B1 | | 4/2001 | Jespersen | |

FOREIGN PATENT DOCUMENTS

| | | | |
|---|---|---|---|
| JP | 2005-199371 | A | 7/2005 |
| JP | 2007-330537 | A | 12/2007 |
| JP | 2009-247714 | A | 10/2009 |

* cited by examiner

CASSETTE BRUSH, A VEHICLE PROVIDED THEREWITH AND A METHOD OF PRODUCING A CASSETTE ELEMENT FOR A CASSETTE BRUSH

TECHNICAL FIELD OF THE INVENTION

The present invention relates to a brush intended for industrial use and a method for producing a cassette element for such a brush.

The invention relates to such a brush of any conceivable type, which can be arranged on tractors, floor sweepers, street sweepers, industrial machines and robots etc., but a brush arranged on some type of airfield runway sweeper may be mentioned as a typical example without restricting the invention thereto.

Such a brush is used for sweeping a surface. Arranged at an airfield runway sweeper the brush is used for sweeping a runway at an airfield so as to keep this free from stones, dust, snow and other objects and substances that may disturb the starts and landings of airplanes. In other examples, such a brush arranged at an industrial machine may be used for removing disturbing particles from a conveyor and arranged at a floor sweeper the brush may be used for cleaning a concrete floor.

BACKGROUND ART

A brush of the type described in the introduction is already known through the U.S. Pat. No. 4,302,863 A.

Said document discloses a brush intended for use in sweeping machines, especially for airfields or streets. This brush has a plurality of cassette elements (brush bridges) intended to be mounted on a cassette element holding member (brush roller) which cassette elements each has a plurality of bristle bunches arranged there along. A body of a said cassette element has recesses (openings) each configured to receive a U-shaped end of a bristle bunch being bent double therein in such a way that the end of the double bent bristle bunch opposite to the U-shaped end projects out of the respective recess, and a securing wire (locking wire) is drawn through the doubled ends of the bristle bunches to lock the bunches against withdrawal at the cassette element.

The bristle bunches of a brush of this type are after approximately 50-100 hours use torn down to such a degree that either the whole brush or the bristle bunches thereof have to be replaced. As the cassette element holding member of the brush is an expensive component and it is time consuming to replace individual bristle bunches the holding member and the cassette elements having the bristle bunches are made separately and then mounted together before use of the brush. One or all of the cassette elements of the brush may therefore fast and easy be replaced when the bristle bunches thereof are so torn down that the result of the sweeping deteriorates.

The major steps of a known method of producing a cassette element intended to be used with a brush of the type defined in the introduction is illustrated through appended FIGS. 1-4.

A cassette element 5*b* having a plurality of bristle bunches 9*b* is produced by:

pressing a middle portion 11*b* of each said bristle bunch 9*b* down in an associated recess 7*b*, located at a first outer surface 8*b* of a body 6*b* of the cassette element 5*b*, by means of either a member 21*b* or by hand, in such a way that the middle portion of a bristle bunch forms substantially a U-shape therein and a first 12*b* and a second end portion 13*b* of said bristle bunch 9*b* extend out of the recess in a direction away from said first outer surface of the body (see FIGS. 1-3), and securing said middle portion 11*b* of each said bristle bunch in the respective recess 7*b* by pressing a securing wire 14*b* into an opening 22*b* at a short side 23*b* of the body 6*b* and over the bristles 10*b* contained in a bottom portion 15*b* of the U-shape of each of the bristle bunches 9*b*, in a direction perpendicular to the extension of the bristle bunches in their bottom portions, so that the securing wire 14*b* secures the bristle bunches 9*b* in the associated recesses 7*b* by urging parts of said U-shape of each bristle bunch 9*b* against surfaces of wall 17*b* and bottom portions 18*b* of the respective recess 7*b* (see FIG. 4).

There are at least two problems related to this method of producing such cassette elements 5*b*. Firstly, there is a risk that the middle portion of individual bristles 10*c* (see FIG. 4) are not being pushed down to a proper position, below said opening 22*b*, in a recess 7*b*. This results in that the securing wire 14*b* will be pressed into the cassette element body 6*b* over the bottom portion 15*b* of the bristle bunch 9*b* but under the middle portions of the bristles 10*c* being out of position with the consequence that these are not secured by the securing wire. This means that a bristle bunch 9*b* of the brush will be one or more bristles 10*c* short leading to impaired efficiency of the brush and in the worst scenario these loose bristles 10*c* will come off during sweeping of a runway and consequently endanger the use of the runway.

Secondly, there is a risk that the middle portion of individual bristles 10*b* are not being pushed down to a proper position, below said opening 22*b*, but is positioned at the same height as the opening 22*b* in a recess 7*b*. This results in that the securing wire 14*b* will be pressed into the cassette element body 6*b* over the bottom portion 15*b* of the bristle bunch 9*b* and into parts of the bristles being out of position with the consequence that these might be damaged before pushed down and secured by the securing wire 14*b*. This means that the damaged bristles eventually will break and come off during sweeping which for instance shortens the life-span of the cassette elements 5*b*. Also, if a few bristles 10*b-c* come off from a bristle bunch 9*b* there is more room for the remaining bristles 10*b* to move and the damage of the brush might be even worse.

A possible but not desirable solution for solving these problems is to let an operator examine and manually push individual bristles 10*c* that are out of position down into the associated bristle bunch 9*b* before the securing wire 14*b* is arranged. This solution would be related to high production costs and consequently an expensive brush for the consumers.

There is a strong desire of providing a brush of this type with cassette elements having bristle bunches secured to that degree that the bristle bunches or individual bristles thereof may never move out of the position in which they are secured to the cassette element body by the securing wire, i.e. to overcome the common problem with brushes of this type already known. This problem occur due to the poorly developed method for producing a cassette element already known, in combination with lack of an effective way of securing the securing wire over the bristle bunches of a cassette element already known, since a poorly secured securing wire may lead to that individual bristles or even a complete bristle bunch is ripped out of a cassette element during use of the brush, and a bristle bunch with missing or damaged bristles may lead to impaired securement of the securing wire.

SUMMARY OF THE INVENTION

The object of the present invention is to provide a brush as well as a method of the type defined in the introduction being improved in at least some aspect with respect to such brushes and methods already known.

This object is according to the invention with respect to the brush obtained by providing such a brush with a said at least one cassette element that further comprises:

means configured to counteract movement of the bristles in said bottom portion of the bristle bunch with respect to each other and/or with respect to said securing wire.

A cassette element provided with said means result in that the risk that individual bristles, a complete bristle bunch and/or the securing wire move during use of the brush, is reduced. This means that the bristle bunches of the brush may be subjected to larger forces during use without limitations in the effectiveness of the brush due to insufficient fixation of the bristles thereof.

According to an embodiment of the invention said means comprises:

a first friction layer portion arranged over or secured to said part of the outer surface of the U-shape of the bristle bunch upon which part the securing wire is applying an urging action, and that said friction layer portion is configured to provide high friction by a first contact surface facing away from said outer surface and a high friction by a second contact surface applied to said outer surface when not secured thereto.

Said first friction layer portion improves the ability of the securing wire to fixate the U-shape of the bristle bunch in the recess by friction locking.

According to another embodiment of the invention said means comprises:

a second friction layer portion arranged between said one or more surfaces of wall and/or bottom portions of the recess and at least a part of the outer surface of the bottom portion of the U-shape of the bristle bunch so as to enable high friction force between these surfaces.

Said second friction layer portion provides a high coefficient of friction between said one or more surfaces of wall and/or bottom portions of the recess and at least a part of the outer surface of the bottom portion of the U-shape of the bristle bunch resulting in that the risk that individual bristles of or a complete bristle bunch move during use of the brush is further reduced, due to an even better ability of the securing wire to fixate the bristle bunch through friction locking.

According to another embodiment of the invention said means comprises:

a holding element provided around the periphery of the bottom portion of the U-shape of the bristle bunch so as to enclose and hold the bristles of the bristle bunch together, said element is preferably a tape, more preferred an adhesive tape, wound around the bristle bunch.

With such a holding element the bristles of a bristle bunch may be held tightly together in the recess which prevents individual bristles of the bristle bunch from moving with respect to each other and thereby results in a better ability of the securing wire to secure the bristle bunch in the recess.

According to another embodiment of the invention the securing wire is coated with a friction layer configured to provide high friction between the securing wire and parts of the cassette element in contact therewith. Said friction layer improves the ability of the securing wire to fixate the U-shape of the bristle bunch in the recess by friction locking.

According to another embodiment of the invention the brush comprises one or more said cassette elements provided with a plurality of bristle bunches.

According to another embodiment of the invention the brush comprises a plurality of cassette elements having a plurality of bristle bunches, each of the bristle bunches of a said cassette element being provided with said means and the bristle bunches of a said cassette element being secured in their respective recesses by the same securing wire.

According to another embodiment of the invention the brush comprises a plurality of said cassette elements.

According to another embodiment of the invention at least a majority, preferably all, of the cassette elements are configured as said at least one cassette element. With at least a majority, preferably all, of the cassette elements configured as said at least one cassette element a durable high-quality brush is obtained.

According to another embodiment of the invention said cassette element holding member has a body with a circular cylindrical shape, said body being provided with said fastening members. This type of cassette element holding member is suitable for a brush of this type.

According to another embodiment of the invention at least a majority, preferably all, of the bristles of a said bristle bunch are made of a synthetic material, preferably a plastic material. This is a suitable material for the bristles of the brush, regarding stiffness and flexibility.

According to another embodiment of the invention the bristles of a said bristle bunch has an individual cross-section diameter of between 0.5 and 10 mm, preferably between 1 and 5 mm, and a said bristle bunch has a total cross-section diameter of between 5 and 50 mm, preferably between 10 and 25 mm. These dimensions are suitable for a brush of this type.

According to another embodiment of the invention the securing wire is made of metal, preferably steel.

According to another embodiment of the invention the brush is configured to be driven by a motor.

The object of the invention is with respect to the method obtained by providing a method according to the independent method claim. The advantages thereof appear from the above discussion of the brush according to the invention and the embodiments thereof, as well as from the following discussion of a method according to the invention.

The invention also comprises a vehicle intended for sweeping a ground, such as a runway on an airfield or a road, which is provided with a brush according to the invention.

Further advantages as well as advantageous features of the invention will appear from the following description of an embodiment of the invention as well as of a method according to the invention.

BRIEF DESCRIPTION OF THE DRAWINGS

With reference to the appended drawings, below follows a specific description of an embodiment of the invention as well as a method according to the invention cited as examples.

In the drawings.

DETAILED DESCRIPTION OF AN EMBODIMENT OF THE INVENTION

Figure 1:
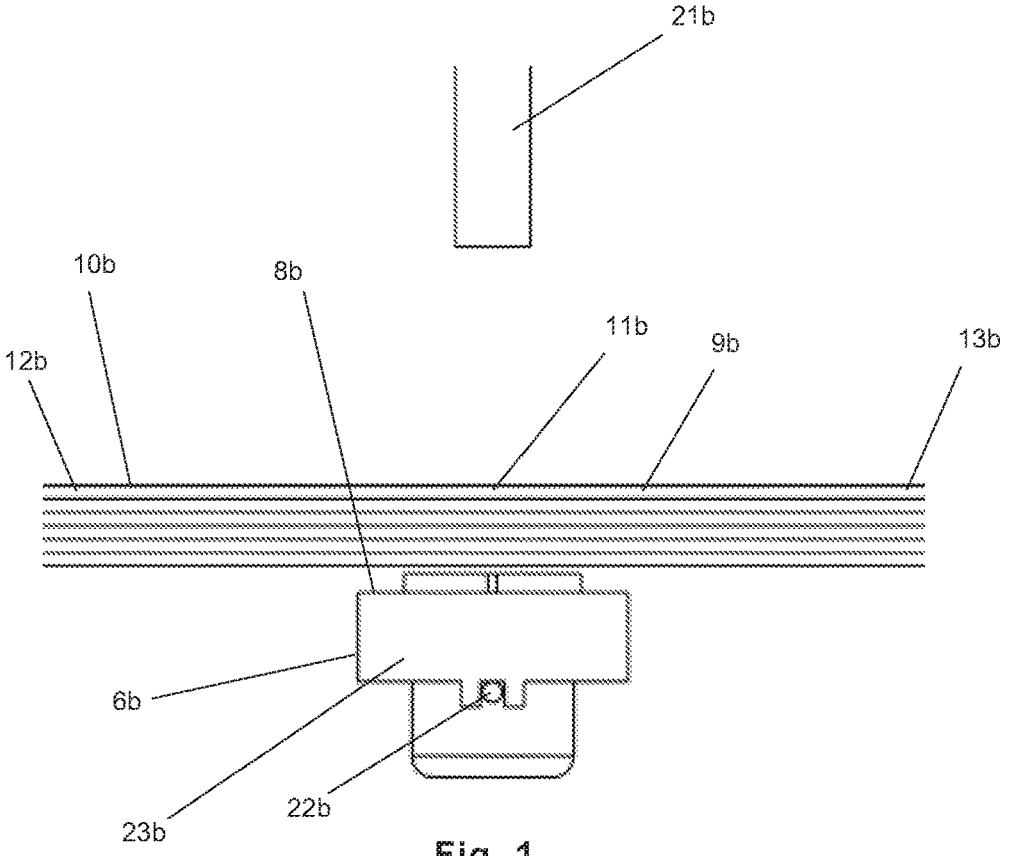
FIG. 1 is a simplified side-elevation view showing a first production step of a method of producing a cassette element already known.
Figure 2:
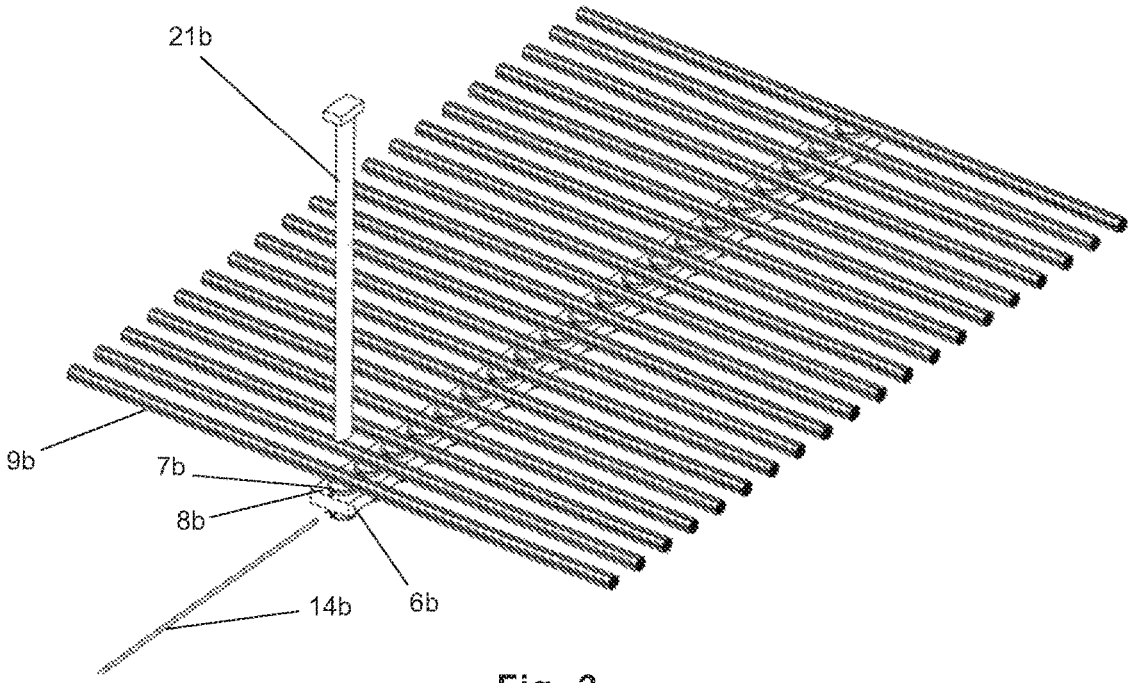
FIG. 2 is a perspective view showing the production step of FIG. 1.
Figure 3:
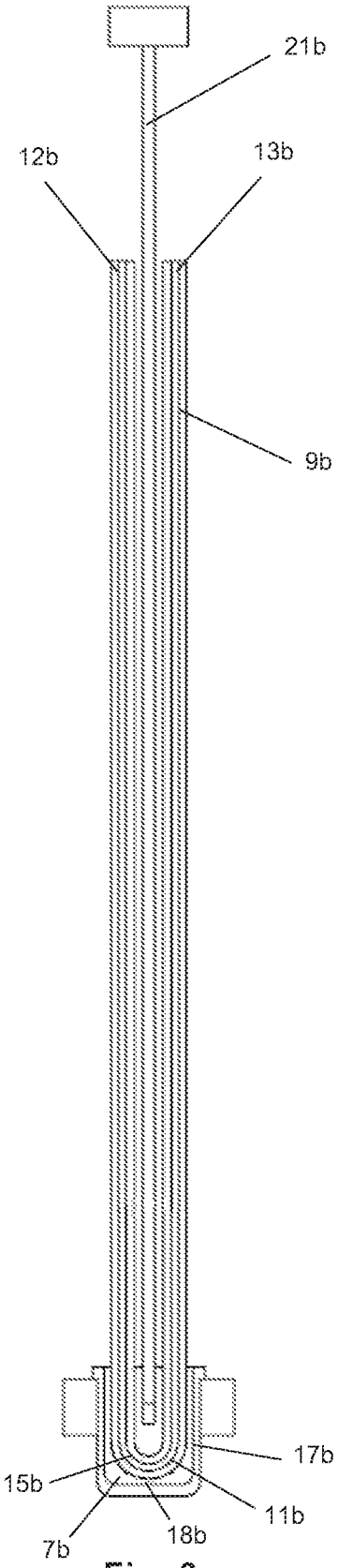
FIG. 3 is a simplified side-elevation view showing a second production step of the method of producing a cassette element already known.
Figure 4:
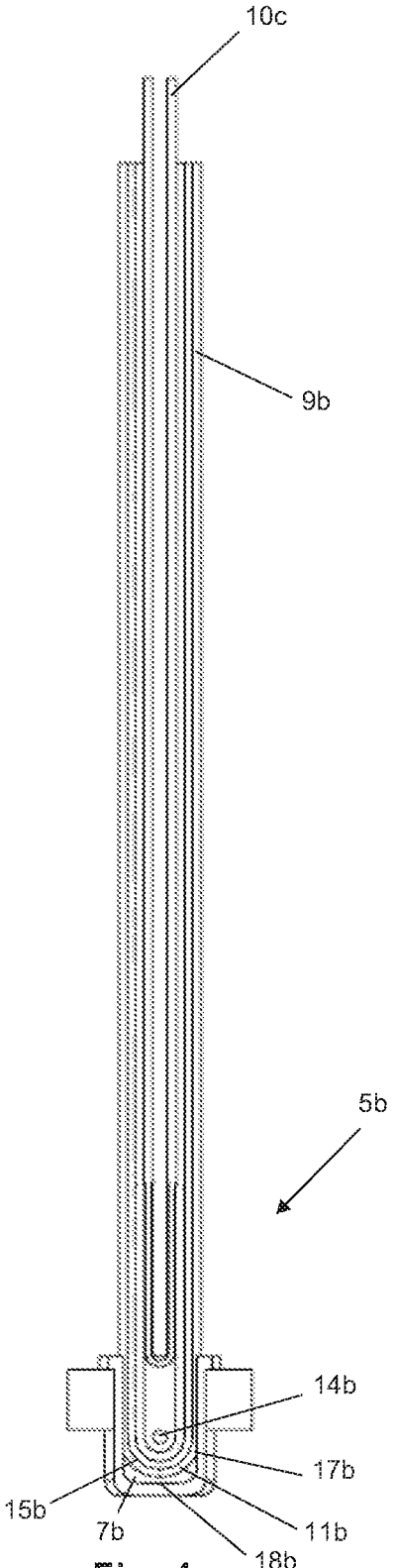
FIG. 4 is a simplified side-elevation view showing a third production step of the method of producing a cassette element already known.
Figure 5:
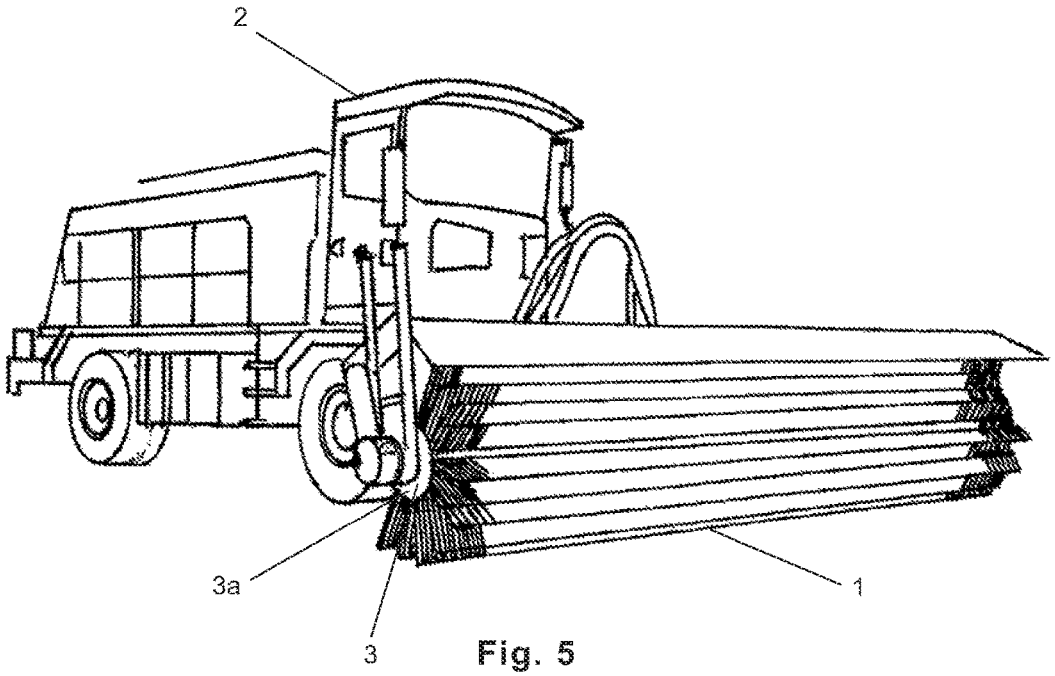
FIG. 5 is a simplified perspective view of an airport runway sweeper provided with a brush according to the invention.
Figure 6:
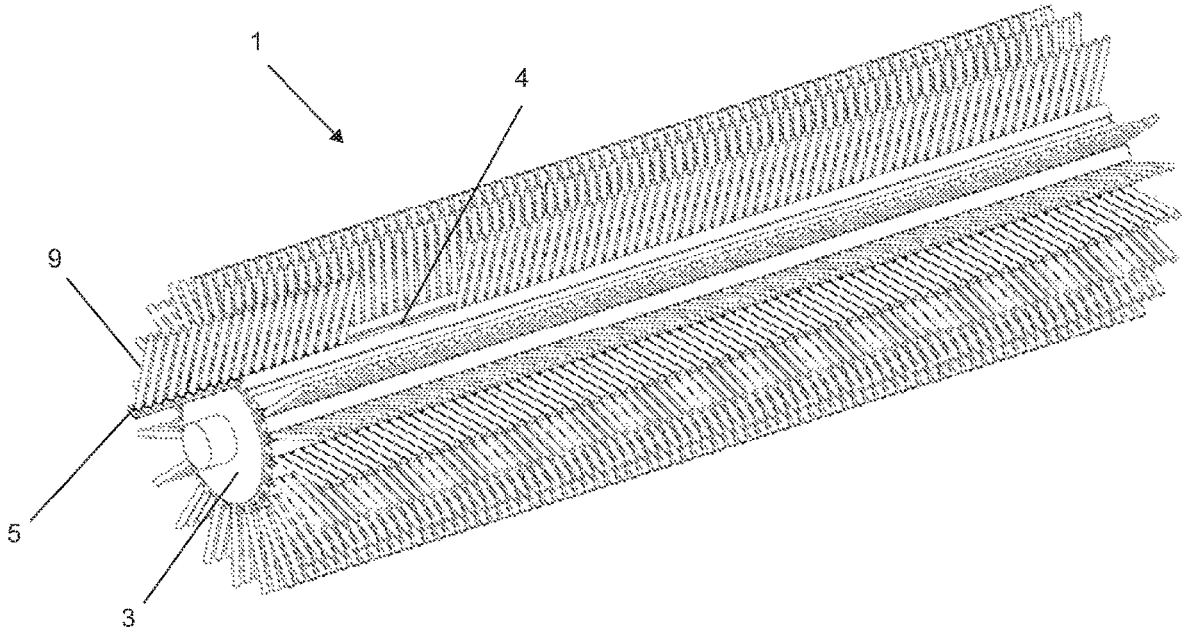
FIG. 6 is an enlarged simplified perspective view of the brush of FIG. 5 during replacement of cassette elements.

A brush 1 according to an embodiment of the invention is illustrated in the appended FIGS. 5-12 and will now be described while at the same time making reference to all these Figures. The brush is intended to be arranged at an airfield runway sweeper 2 used for keeping a runway at an airfield free from stones, dust, snow etc. Sweeping of a runway on an airfield calls for high quality requirements of the brush 1 and its components as unwanted objects on the runway might be a danger at a take-off or landing of an airplane thereon.

The brush 1 comprises a circular cylindrical cassette element holding member 3 configured to be rotated during use of the brush. The holding member has a body 3*a* provided with fastening members in the form of elongated grooves 4, each configured to removably secure a series of cassette elements 5 at the body 3*a* of the holding member 3. To secure the cassette elements at said body, these are pushed into a groove 4 through an opening thereof at one end of the body. As the groove is filled with cassette elements a locking disc is arranged at said end of the body 3*a* to close said opening and the cassette elements 5 are secured through fit locking with the groove 4. To remove one or all of the cassette elements the locking disc is simply dismounted from the holding member 3 and the cassette elements 5 may be pulled out of said opening (see FIG. 6).

Each cassette element 5 comprises an elongated body 6 provided with a plurality of recesses 7 at a first outer surface 8 thereof. The recesses are provided with bristle bunches 9, formed by a plurality of elongated bristles 10, in such a way that a middle portion 11 of a bristle bunch 9 is pushed down in a recess 7 in such a way that the middle portion forms substantially a U-shape therein and a first 12 and a second end portion 13 of the bristle bunch extend out of the recess in a direction away from said first outer surface 8 of said body 6. The bristles 10 are made of a plastic material, preferably polypropylene.

A securing wire 14 made of steel secures all said bristle bunches 9 of a cassette element 5 in the respective recesses 7 by extending over every bristle 10 contained in a bottom portion 15 of the U-shape of the bristle bunches, tightly over said bottom portion of the U-shape and in a direction perpendicular to the extension of the bristle bunches 9 in said bottom portion 15 so as to secure the bristle bunches in the recesses by urging parts of an outer surface 16 of said U-shape of the bristle bunches against one or more surfaces of wall 17 and/or bottom portions 18 of the recesses 7. Said outer surface 16 extends around the complete periphery of the bottom portion 15 of a bristle bunch 9. The bottom portion 15 is in this disclosure considered to be the curved part of the U-shape of a bristle bunch.

Every bristle bunch 9 is provided with a holding element 20 in the form of an adhesive tape wound around the complete periphery of the bottom portion 15 of the U-shape of each bristle bunch so as to enclose and hold the bristles 10 of a bristle bunch together.

Through this holding element 20 it is ensured that the bristles 10 of a bristle bunch 9 are arranged as a unit in the recess 7 and thereby that individual bristles are prevented from moving out of their position in the bristle bunch. Also, due to that at least outer portions (20*a-b*) of the adhesive tape has a high coefficient of friction and thereby a high coefficient of friction is provided at least between said surfaces 16-18 each bristle bunch 9 will be retained in a predetermined proper position in the respective recess 7 even when subjected to large forces during use of the brush 1. Preferably, the complete outer surface of a holding element 20 facing away from the bristle bunch 9 around which the holding element is arranged, is a surface configured to provide high friction against surrounding parts in a cassette element 5.

The bristles 10 of a bristle bunch 9 has an individual cross-section diameter of between 0.5 and 10 mm, preferably between 1 and 5 mm, and a bristle bunch has a total cross-section diameter of between 5 and 50 mm, preferably between 10 and 25 mm, when it is not double folded. A bristle bunch typically consists of between 20 and 40 individual bristles. The numbers presented above may vary and be adapted to suit the use of the brush 1. For instance, a brush intended for sweeping snow may have fewer and thicker bristles than a brush intended for sweeping dust.

Figure 7:
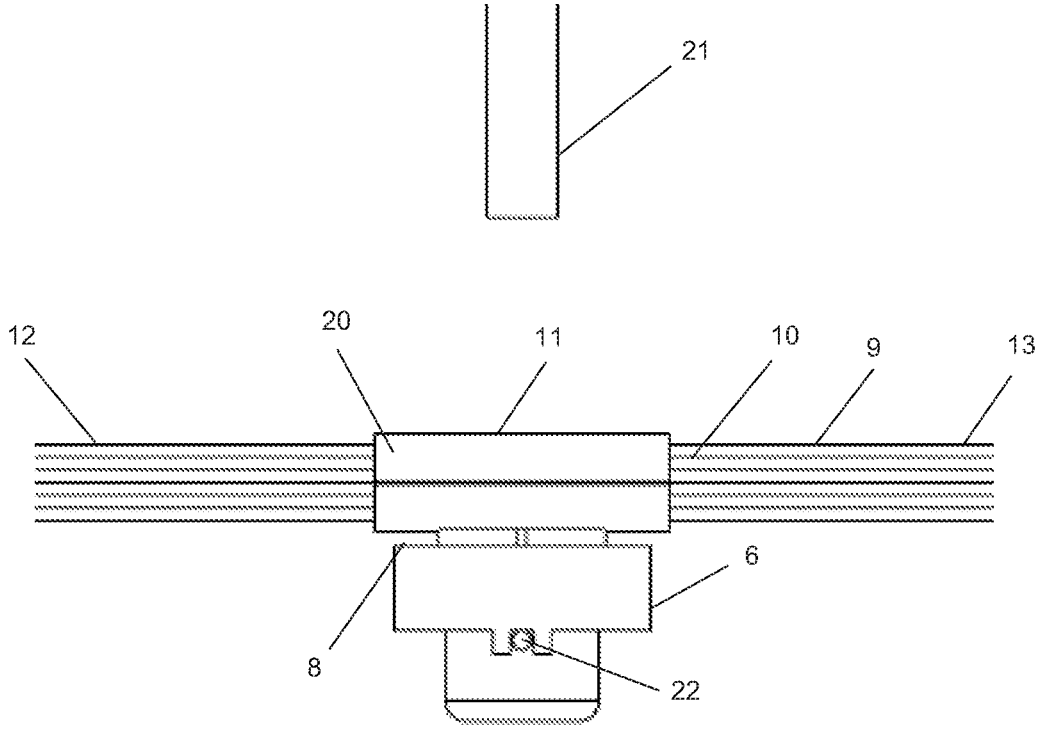
FIG. 7 is a simplified side-elevation view showing a first production step of a method of producing a cassette element according to the invention.
Figure 8:
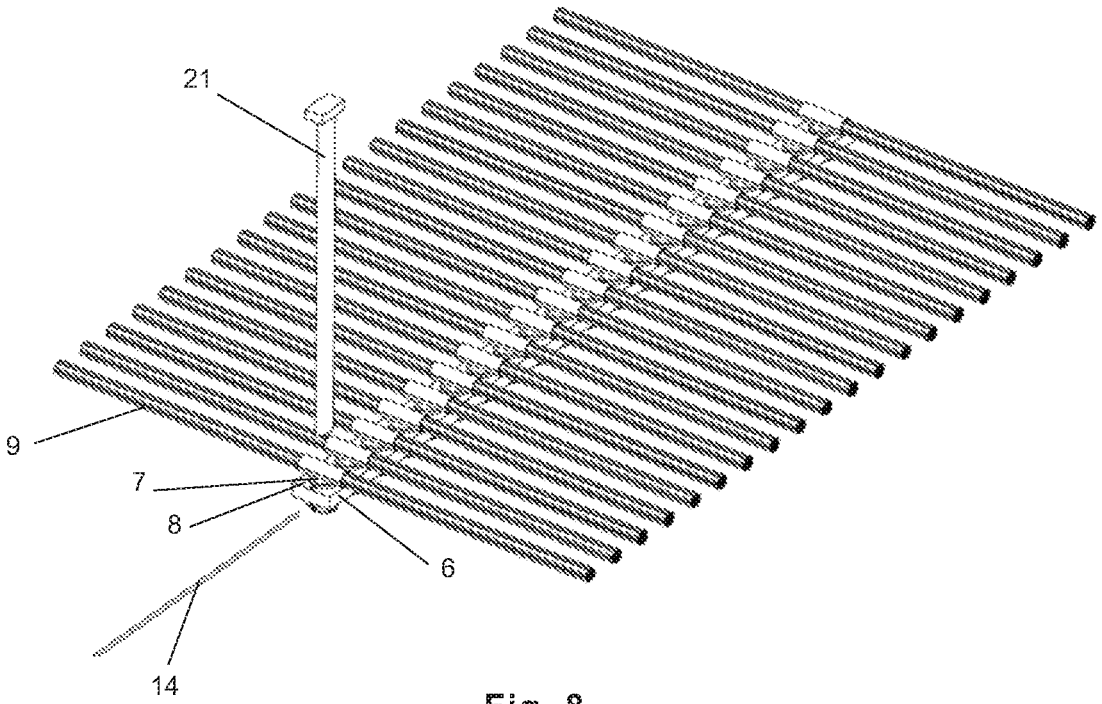
FIG. 8 is a perspective view showing the production step of FIG. 7.

In a method of producing a cassette element 5 according to an embodiment of the invention a holding element 20 is arranged around the complete periphery of the middle portion 11 of each said bristle bunch 9 before these are pushed down in the associated recesses 7 by a member 21 (see FIG. 7-8). An easy way of performing this is to wind an adhesive tape around the middle portion 11 of the bristle bunches.

Figure 9:
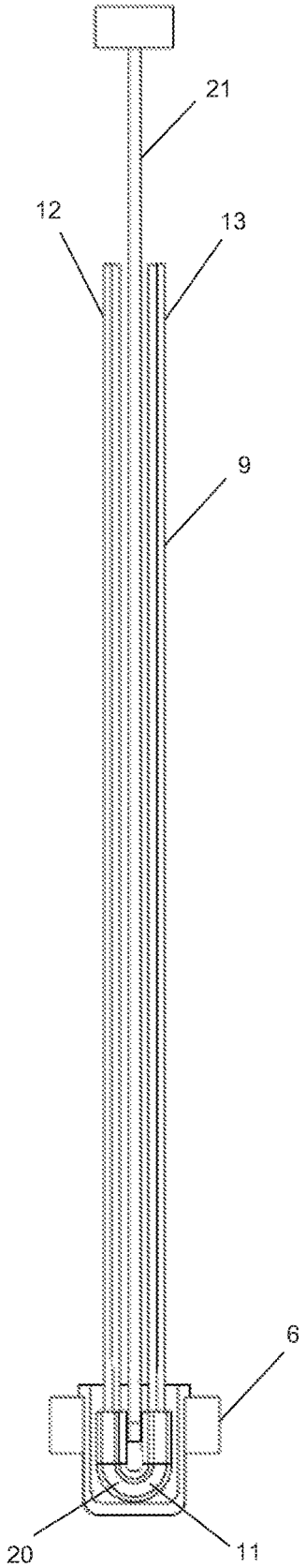
FIG. 9 is a simplified side-elevation view showing a second production step of the method of producing a cassette element according to the invention.
Figure 10:
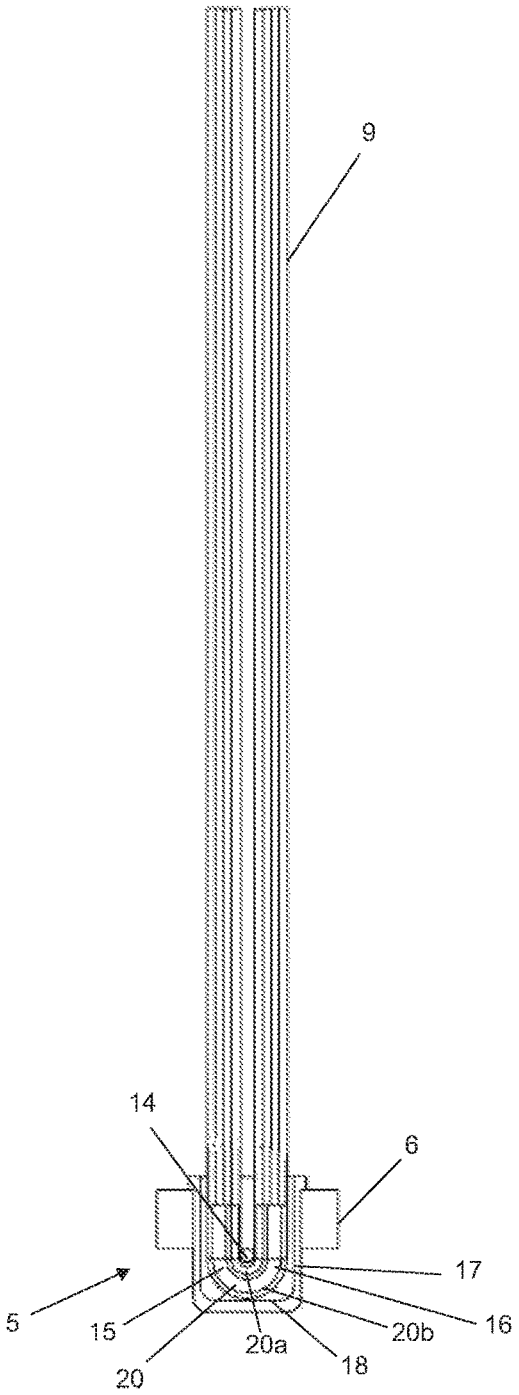
FIG. 10 is a simplified side-elevation view showing a third production step of the method of producing a cassette element according to the invention.

The holding element 20 will then enclose and hold the bristles 10 together as a unit at the middle portion 11 of each bristle bunch 9 so that all of the bristles 10 of a bristle bunch 9 will be pushed down to a proper position, below an opening 22 (see FIG. 7) through which the securing wire 14 is inserted into the cassette element body 6, in the associated recess 7 (see FIG. 9). This means that the securing wire will be pressed into the cassette element body 6 over every bristle 10 contained in the bottom portion 15 of the bristle bunches 9 and secure the bristle bunches in a proper position and without the risk of damaging any individual bristles thereof (see FIG. 10). Consequently, the problems with the method already known addressed above are solved in an easy and cost-effective way and a method of producing cassette elements 5 for a brush 1 that is efficient to use and has an extended life-span compared to such brushes already known is provided.

The invention is of course not in any way restricted to the embodiment thereof described above, but many possibilities to modifications thereof will be apparent to a person with ordinary skill in the art without departing from the scope of the invention as defined in the appended claims.

The holding element may for instance be some other element than an adhesive tape, for example a textile strip or a thread wound around a bristle bunch. However, a thin thread wound around a bristle bunch in a single loop only is considered to not be such a holding element. If a thin thread is used to form a holding element, this has to be wound in multiple loops around a bristle bunch, to form a unit of threads which unit is considered to be the holding element. The width of a holding element arranged around a bristle bunch is at least 3-5 mm, preferably at least 10 mm, more preferred at least 20 mm.

The friction layer portions may be portions of the holding element but may also be portions of an additional element, such as a textile strip arranged over and/or under the bottom portion of a bristle bunch in a recess, and said first friction layer portion may even be a portion of a layer provided on the outer surface of the securing wire, such as a thin rubber layer. The friction layer portions may have a thickness of 5 mm, 3 mm, preferably 2 mm, more preferred 1 mm.

That a friction layer portion "provides high friction" or "enables a high friction force" between two surfaces means that the coefficient of friction between these surfaces is higher with the friction layer portion arranged there between than without this.

The fastening members being elongated grooves configured to secure the cassette elements through fit locking may be formed in some other way, and may also be configured to secure the cassette elements at the holding member through other means, such as by magnets or screws.

A cassette element holding member with a body having a circular cylindrical shape is one type of such a holding member. However, the body of the holding member may for instance have the shape of a cone or be substantially flat.

A brush according to the invention may be provided with only one cassette element but may also be provided with up to 100 cassette elements, or even more. Also, such a cassette element may have only one bristle bunch, 2-10, 11-20, 21-30 bristle bunches or even more.

The phrase "industrial use" as used in this disclosure refers to such use that is not commonly performed in a regular household. For example, use of a broom is considered to not be included in this definition, even if it is used in an industrial facility.

The word "wire" as used in this disclosure in the phrase "securing wire" is not to be interpreted as it has to be flexible but may also be an elongated thin rod, such as a thin steel rebar or the like.

Figure 11:
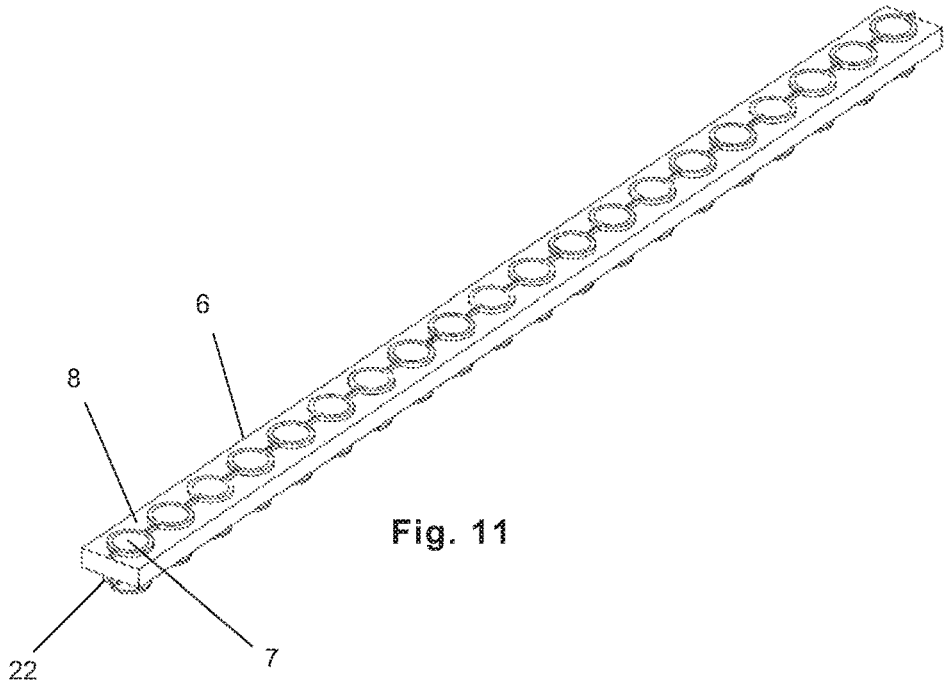
FIG. 11 is a simplified perspective view of a cassette element body of a brush according to the invention.
Figure 12:
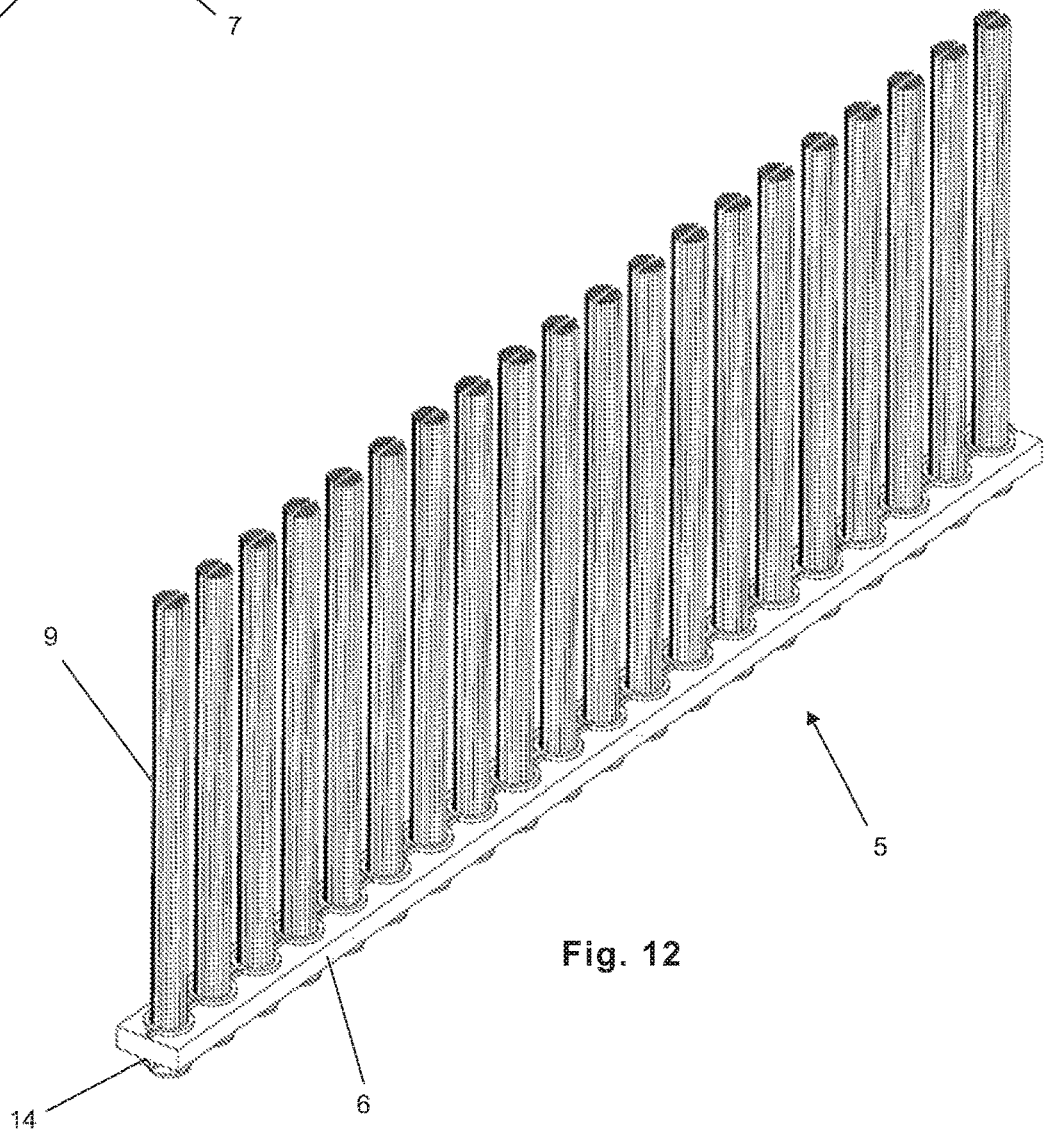
FIG. 12 is a simplified perspective view of a cassette element according to the invention.

That a recess is provided "at" a first outer surface of a cassette element body also includes that the opening of such a recess may be located above said first outer surface, protruding therefrom (as shown in FIG. 11, as an example).

The invention claimed is:

1. A brush (1) intended for industrial use comprising:

one or more bristle bunches (9), each formed by a plurality of elongated bristles (10), one or more cassette elements (5), each having at least one said bristle bunch (9), and a cassette element holding member (3) provided with one or more fastening members (4), each fastening member (4) being configured to removably secure at least one said cassette element (5) at the holding member (3), at least one of said cassette elements (5) comprising:

a body (6), one or more recesses (7) at a first outer surface (8) of said body (6), each recess (7) being configured to receive a middle portion (11) of a bristle bunch (9) therein, and a securing wire (14) configured to secure said middle portion (11) of said bristle bunch (9) in said recess (7), with the middle portion (11) of the bristle bunch (9) pushed down in the recess (7) such that the middle portion (11) forms a substantially U-shape therein and a first (12) and a second end portion (13) of the bristle bunch (9) extends out of the recess (7) in a direction away from said first outer surface (8) of said body (6), by extending over every bristle (10) contained in a bottom portion (15) of the U-shape of the bristle bunch (9), in a direction perpendicular to the extension of the bristle bunch (9) in said bottom portion (15), to secure the bristle bunch (9) in the recess (7) by urging parts of said U-shape of the bristle bunch (9) against one or more surfaces of wall (17) and/or bottom portions (18) of the recess (7), wherein at least a majority of the bristles (10) of each said bristle bunch (9) are made of a synthetic material, said at least one cassette element (5) further comprises:

means configured to counteract movement of the bristles (10) in said bottom portion (15) of the bristle bunch (9) with respect to each other and/or with respect to said securing wire (14), and said means comprises:

a holding element (20) provided around the periphery of the bottom portion (15) of the U-shape of the bristle bunch (9) to enclose and hold the bristles (10) of the bristle bunch (9) together, said element (20) being a tape wound around the bristle bunch (9).

2. A brush (1) according to claim 1, wherein said means comprises:

a first friction layer portion (20*a*) arranged over or secured to said part of the outer surface (16) of the U-shape of the bristle bunch (9) upon which part the securing wire (14) applies an urging action, and said friction layer portion (20*a*) is configured to provide high friction by a first contact surface facing away from said outer surface (16) and high friction by a second contact surface applied to said outer surface (16) when not secured thereto.

3. A brush (1) according to claim 1, wherein said means comprises:

a friction layer portion (20*b*) arranged between said one or more surfaces of wall (17) and/or bottom portions (18) of the recess (7) and at least a part of the outer surface (16) of the bottom portion (15) of the U-shape of the bristle bunch (9) to enable high friction force between these surfaces (16-18).

4. A brush (1) according to claim 1, wherein the brush (1) comprises one or more said cassette elements (5) provided with a plurality of bristle bunches (9).

5. A brush (1) according to claim 1, wherein the brush (1) comprises a plurality of cassette elements (5) provided with a plurality of bristle bunches (9), each of the bristle bunches (9) of a cassette element (5) being provided with said means (20) and the bristle bunches (9) of said cassette element (5) being secured in their respective recesses (7) by the same securing wire (14).

6. A brush (1) according to claim 5, wherein at least a majority of the cassette elements (5) of the brush (1) are configured as said at least one cassette element (5).

7. A brush (1) according to claim 6, wherein all of the cassette elements (5) of the brush (1) are configured as said at least one cassette element (5).

8. A brush (1) according to claim 1, wherein the brush (1) comprises a plurality of said cassette elements (5).

9. A brush (1) according to claim 1, wherein said cassette element holding member (3) has a body (3*a*) with a circular cylindrical shape, said body (3*a*) being provided with said fastening members (4).

10. A brush (1) according to claim 1, wherein the bristles (10) of a bristle bunch (9) have an individual cross-section diameter of between 0.5 and 10 mm and said bristle bunch (9) has a total cross-section diameter of between 5 and 50 mm.

11. A brush (1) according to claim 10, wherein the bristles (10) of a bristle bunch (9) have an individual cross-section diameter of between 1 and 5 mm, and said bristle bunch (9) has a total cross-section diameter of between 10 and 25 mm.

12. A brush (1) according to claim 1, wherein the securing wire (14) is made of metal.

13. A brush (1) according to claim 12, wherein the securing wire (14) is made of steel.

14. A brush (1) according to claim 1, wherein the brush (1) is configured to be driven by a motor.

15. A brush (1) according to claim 1, wherein all of the bristles (10) of each said bristle bunch (9) are made of a synthetic material.

16. A brush (1) according to claim 15, wherein said bristles (10) are made of plastic.

17. A brush (1) intended for industrial use comprising:

one or more bristle bunches (9), each formed by a plurality of elongated bristles (10), one or more cassette elements (5), each having at least one said bristle bunch (9), and a cassette element holding member (3) provided with one or more fastening members (4), each fastening member (4) being configured to removably secure at least one said cassette element (5) at the holding member (3), at least one of said cassette elements (5) comprising:

a body (6), one or more recesses (7) at a first outer surface (8) of said body (6), each recess (7) being configured to receive a middle portion (11) of a bristle bunch (9) therein, and a securing wire (14) configured to secure said middle portion (11) of said bristle bunch (9) in said recess (7), with the middle portion (11) of the bristle bunch (9) pushed down in the recess (7) such that the middle portion (11) forms a substantially U-shape therein and a first (12) and a second end portion (13) of the bristle bunch (9) extends out of the recess (7) in a direction away from said first outer surface (8) of said body (6), by extending over every bristle (10) contained in a bottom portion (15) of the U-shape of the bristle bunch (9), in a direction perpendicular to the extension of the bristle bunch (9) in said bottom portion (15), to secure the bristle bunch (9) in the recess (7) by urging parts of said U-shape of the bristle bunch (9) against one or more surfaces of wall (17) and/or bottom portions (18) of the recess (7), wherein at least a majority of the bristles (10) of each said bristle bunch (9) are made of a synthetic material, said at least one cassette element (5) further comprises:

means configured to counteract movement of the bristles (10) in said bottom portion (15) of the bristle bunch (9) with respect to each other and/or with respect to said securing wire (14), and the securing wire (14) is coated with a friction layer configured to provide high friction between the securing wire (14) and parts of the cassette element in contact therewith.

18. A brush (1) according to claim 17, wherein all of the bristles (10) of each said bristle bunch (9) are made of a synthetic material.

19. A brush (1) according to claim 18, wherein said bristles (10) are made of plastic.

20. A vehicle (2) intended for sweeping a ground, wherein the vehicle (2) is provided with a brush (1) according to claim 1.

* * * * *